United States Patent [19]

Aalto et al.

[11] Patent Number: 4,811,724

[45] Date of Patent: Mar. 14, 1989

[54] AIR EXHAUSTING MEANS

[75] Inventors: Erkki Aalto, Kausala; Kaarlo Korhonen, Kouvola; Jorma Pekkinen, Kausala; Esa Sundberg, Kausala; Arvi Tolmunen, Kausala; Seppo Vartiainen, Kouvola; Reijo Villikka, Kausala, all of Finland

[73] Assignee: Halton Oy, Finland

[21] Appl. No.: 10,277

[22] PCT Filed: Sep. 13, 1985

[86] PCT No.: PCT/F185/00076

§ 371 Date: Dec. 5, 1986

§ 102(e) Date: Dec. 5, 1986

[87] PCT Pub. No.: WO86/06154

PCT Pub. Date: Oct. 23, 1986

[30] Foreign Application Priority Data

Apr. 12, 1985 [FI] Finland ..... 851477

[51] Int. Cl.[4] ..... F24C 15/20

[52] U.S. Cl. ..... 126/299 D; 98/36

[58] Field of Search ..... 98/36; 126/299 D, 299 R

[56] References Cited

U.S. PATENT DOCUMENTS

| | | | |
|---|---|---|---|
| 3,952,640 | 4/1976 | Kuechler | 55/DIG. 36 |
| 3,978,777 | 9/1976 | Nett | 126/299 D |
| 4,047,519 | 9/1977 | Nett | 126/299 D |
| 4,056,877 | 11/1977 | Kuechler | 52/741 |
| 4,109,641 | 8/1978 | Hunzicker | 126/299 D |
| 4,117,833 | 10/1978 | Mueller | 126/299 D |
| 4,146,017 | 3/1979 | Overton | 126/299 D |
| 4,286,572 | 9/1981 | Searly et al. | 55/DIG. 36 |
| 4,467,782 | 8/1984 | Russell | 126/299 D |

*Primary Examiner*—Henry A. Bennet

*Attorney, Agent, or Firm*—Steinberg & Raskin

[57] ABSTRACT

The present invention concerns an air exhausting device, intended primarily for catering industry kitchens or equivalent. The air exhausting device comprises an outer housing, an exhaust chamber with at least one air aperture or grease filter unit, a collecting chamber for gaseous impurities and a blow chamber. The blow apertures of the blow chamber of the air exhausting device are disposed to produce a blow jet which induces a secondary air jet, which has on all sides of the blow apertures been arranged to act on its entirety in the proximity effect area. Above the blow apertures of the blow chamber has been disposed a guide baffle, arranged to direct the blow jet towards the grease filters to that the maximally efficient starting impulse of the blow jet is achieved, this impulse being arranged to substantially die out before arriving at the grease filter.

30 Claims, 4 Drawing Sheets

AIR EXHAUSTING MEANS

BACKGROUND OF THE INVENTION

The present invention concerns air exhausting means, intended in particular for kitchens in catering industry or equivalent, said air exhausting means comprising an outer housing, an exhausting chamber provided with at least one suction aperture or grease filter unit, a collector chamber for gaseous impurities, and a blow chamber, in the vicinity of which a guide baffle may be disposed.

The ventilation of catering industry kitchens, grill bars or equivalent is very difficult to manage, as is well-known. From the kitchen equipment are released various waste heat loads, such as fumes, vapours, etc., which should be managed in order to achieve successful ventilation.

Ventilation of catering industry kitchens can be understood as a system of process ventilation. In a catering industry kitchen, the food preparation apparatus constitutes the locations where impure air is released. Good interior air conditions can be created only if the spreading of impurities released in the working area of the kitchen to that zone of the kitchen where persons are staying, and particularly their spread in the respiration air zone, can be prevented.

Presently, the details mentioned in the foregoing have been taken into account, and apparatus for kitchens in catering industry have been developed very intensively. With the means of prior art, endeavours are made to eliminate the produced waste heat and impure air in such a way that the waste heat and impure air cannot at all spread in the kitchen. To this type belongs apparatus such as washing machines and ovens, the vapours and fumes produced in them being removed directly from within the means to an air exhausting duct system. In this case, however, a so-called closed system is concerned.

However, all kitchen apparatus in catering industry cannot be directly connected to the air exhausting duct system so that the working conditions in the catering kitchen are not affected. This kind of equipment includes stoves, kettles, grid irons, grills, frying pans and fat baths. The impurities released from this kind of apparatus frequently enter the personnel's respiration air zone, thus impairing their working conditions. The distribution of fresh air to the respiration air zone is frequently an overwhelming task because the impurities are mixed with the intake air before it has reached the respiration air zone of the workers. Endeavours have been made to eliminate the drawbacks mentioned in the foregoing by constructing a so-called steam cowl over the kitchen apparatus, but the operation of the steam cowl appliances of existing art is unsatisfactory. The functioning of steam cowls depends on the degree of their encapsulation, on their shape, front face area, exhaust air quantity, and on the location of the suction aperture. In addition, the above factors are interdependent.

Recommendable front face velocities have been stated in pertinent literature for various local exhaust points. In catering industry kitchens, for the front face velocity, or the so-called capture velocity, a value 0.25 to 0.7 m/s per kitchen cowl front face area is recommended. At flow rate 0.25 m/s, only so-called slow flows carrying only little heat and vapours can be captured. With increasing convection, higher capture velocities are required.

It has been found in practice that the values mentioned in the foregoing are not applicable in designing because the exhaust air quantities would become excessive so that the required substitution air cannot be led into the kitchen space without incurring draught. Therefore, the designers have reduced the exhaust air quantities according to their own judgement, whereby the quantities of air used in catering industry kitchens have been made implementable.

When the front face velocity is reduced, the consequence is that part of the spoiled kitchen air can escape to the respiration air zone, owing to the reduction of the so-called capture velocity. Hereby, the kitchen cowl is no longer operative, and the humidity of the air and its temperature gradient become disadvantageous in the kitchen. The situation presented in the foregoing is still present in all types of air exhausting apparatus used in catering industry kitchens at present.

As to the state of art, reference is made to the Finnish Pat. No. 58971, the U.S. Pat. No. 4,286,572 and the Swedish publizicing print No. 7904443-4, in which some of the designs known in present art are disclosed.

The designs known in the art have numerous drawbacks. The designs are usually over-dimensioned as regards their exhaust air and marginal blowing quantities. The designs of prior art produce a blow jet, the shape of which is unsatisfactory. Likewise, the flow field is unfavourable, and the design of the margins and interior of the cowl is unsatisfactory. In the designs presently known, control of the air quantity is moreover difficult to accomplish. Furthermore, in the designs of prior art there is no possibility to adjust the grease filters by which the grease filtering efficiency could be influenced.

SUMMARY OF THE INVENTION

The object of the present invention is to provide an improvement in the respective designs known in the art. The aims of the invention are achieved with air exhausting means which is mainly characterized in that the blow apertures of the blow chamber of the air exhausting means have been disposed to deliver a blow jet which induces a secondary air jet, which has been disposed on all sides of said blow apertures in its entirety to act in the proximity action area, and that in the vicinity of said blow apertures of the blow chamber has been disposed a guide baffle, arranged to direct said blow jet towards the suction aperture or towards the grease filters so that a maximally efficient ejection effect of said blow jet is obtained in the proximity action area, and an outgoing impulse which has been arranged to die out substantially before arriving at said suction aperture or grease filter.

The rest of the characteristic features of the blow means of the invention are stated further below.

With the air exhausting means of the invention, a plurality of remarkable advantages are gained. Firstly, with the design of the invention a minimal blowing quantity is obtained, yet at the same time a very high impulse and the desired turbulence. Moreover, in the design of the invention the so-called mixing coefficient can be made very high. As taught by the invention, the controlled air flow breaks the ascending, so-called convection flows. In the design of the invention, the escape of impurities from the air exhausting means to the zone where the workers are staying is prevented. The design of the invention furthermore gives the operating personnel the chance to increase, respectively to reduce, the blow quantity, and in this manner to control the entering air jet, thus altering the air flow fields prevailing in the kitchen.

In the design of the invention, the entering air jet can be dimensioned so that the air jet inhibits the effect of the interference turbulences, which usually occur under the means of the invention, on the end result. In the design of the invention, it is moreover possible, in fact, to minimize the air quantities used and still to achieve the desired result. In the design of the invention, the shaping of the exhaust air margins guarantee laminar flow from the margins inwards. Likewise, in the design of the invention the effect of radiant heat can be substantially reduced.

BRIEF DESCRIPTION OF THE DRAWINGS

The invention is described in detail by referring to certain advantageous embodiments of the invention presented in the figures of the drawing attached, but to which the invention is not meant to be exclusively confined. In the drawings

DESCRIPTION OF THE PREFERRED EMBODIMENTS

Figure 1:
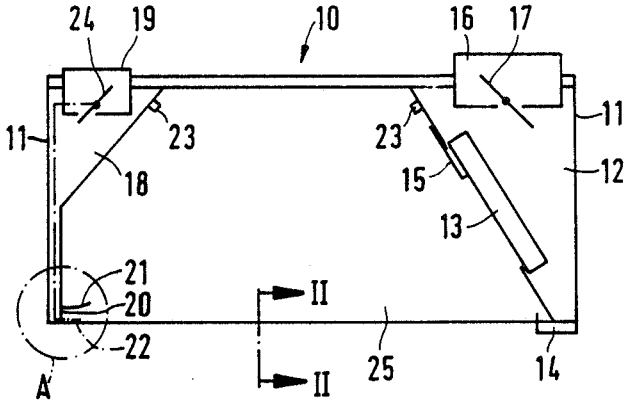
FIG. 1 presents an advantageous embodiment of the air exhausting means of the invention in schematic elevational view.
Figure 2:
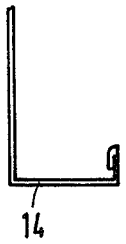
FIG. 2 shows the section along the line II-II in FIG. 1.
Figure 3:
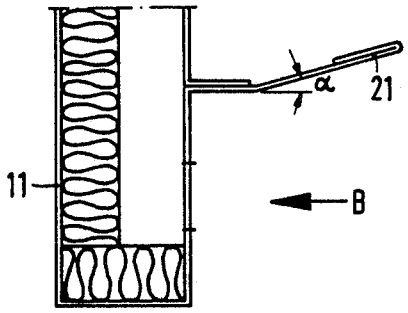
FIG. 3 shows the detail A in FIG. 1 on an enlarged scale.
Figure 4:
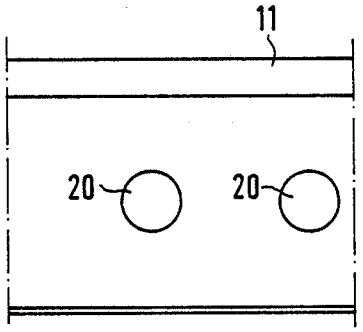
FIG. 4 shows FIG. 3, as viewed in the direction B.

In the embodiment of FIGS. 1–4, the air exhausting means of the invention in general has been indicated by reference numeral 10. In this embodiment, the air exhausting means 10 comprises an outer housing 11, an exhaust chamber 12, a collecting chamber 25 for gaseous impurities and a blow chamber 18. As is shown in FIG. 1, the exhaust chamber 12 is provided with one or several grease filter units 13. Instead of the grease filter 13, there may of course be a mere suction aperture. With reference numeral 14 is indicated a grease channel and collecting box. The filters 13 of the grease filter are provided with a damper 15, with the aid of which the amount of air flow through the filters 13 can be regulated. Moreover, the exhaust chamber 12 comprises, in a manner known in itself, a connection 16 communicating with the exhaust air duct system, and a control damper 17, with which the air quantity flowing into the duct system can be regulated. The control damper 17 may of course equally be a fire damper. The differential pressure measuring points are indicated by reference numeral 23. The amount of the blow and exhaust air quantities can be determined with the aid of differential pressure $\Delta p$ measured with the aid of the differential pressure measuring points 23.

As taught by an important characteristic feature of the invention, the blow chamber 18 is provided, in its lower part, with a plurality of blow apertures 20, arranged to provide the desired starting impulse of the blow air. The blow chamber 18 comprises a connector 19 communicating with the air intake ducts (not depicted), and said connector is provided with a control damper 24 which may be operated with operating means 22 provided close to the blow apertures 20.

As shown in FIGS. 1–4, the blow apertures 20 and the guide baffle 21 disposed above the blow apertures have been fitted to exert an effect on the incoming air flow such that the desired starting impulse is achieved and that the directional blow jet is arranged to die out before entering the grease filter 13. The guide baffle 21 is advantageously arranged to serve as grease channel on the side adjacent to the blow chamber 18.

Figure 5:
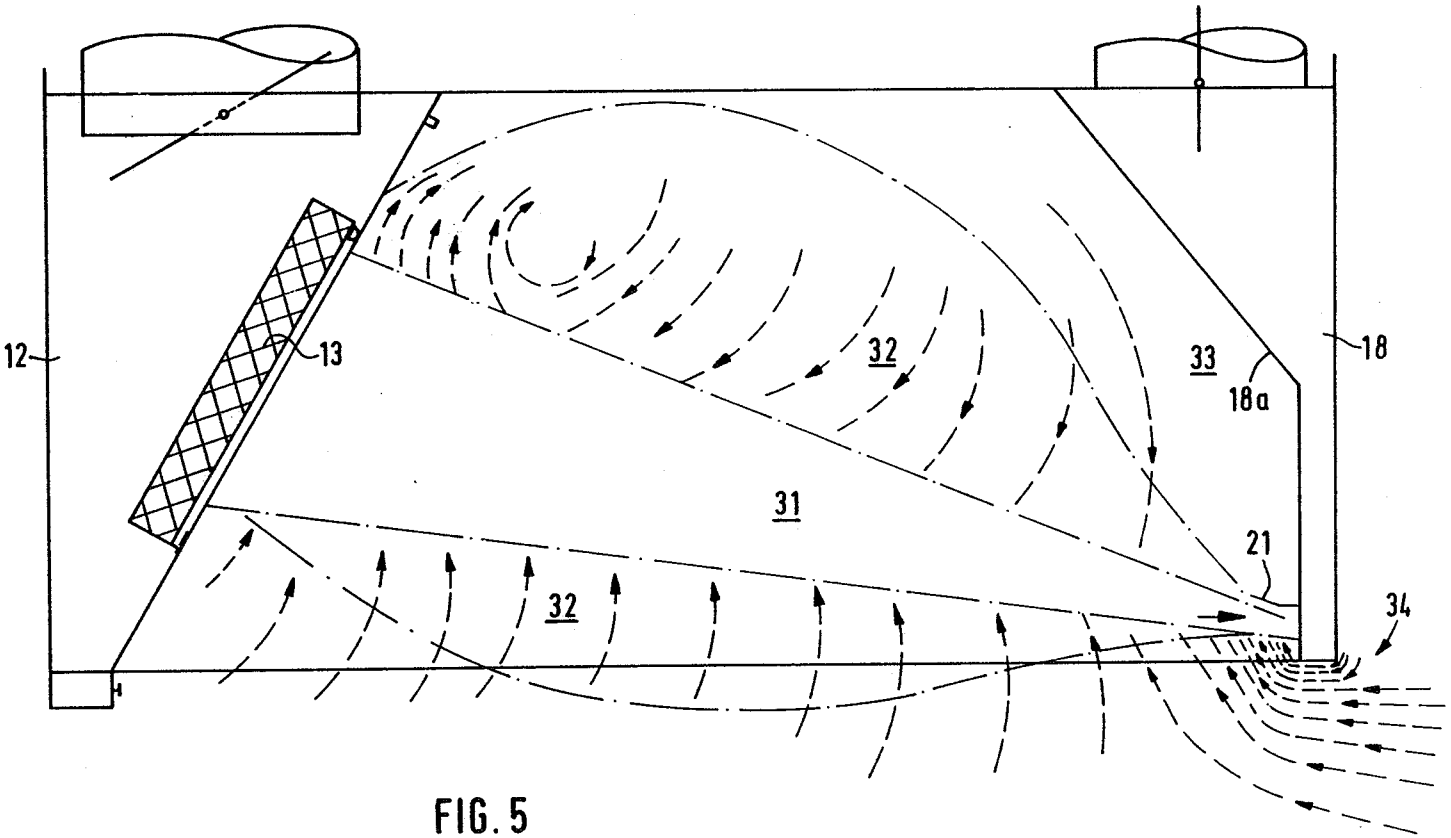
FIG. 5 shows FIG. 1 on an enlarged scale, the air flows of the air exhausting means of the invention being indicated in this figure.
Figure 6:
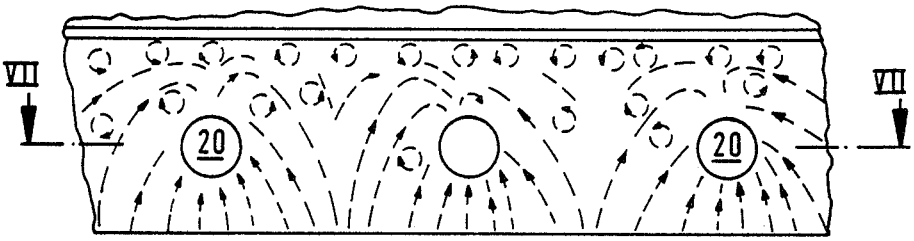
FIG. 6 shows FIG. 5, as viewed in the direction C.
Figure 7:
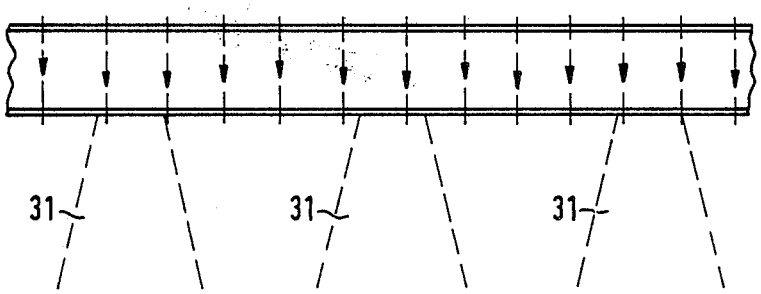
FIG. 7 presents the section along the line VII-VII in FIG. 6.

It is thus understood that in the design of the invention the procedure shown in FIGS. 5–7 is applied so that in the proximity effect area, indicated in FIG. 5 with reference numeral 34, the incoming air jet is so formed that its starting impulse is very high. It should be noted that the worker is working below the proximity effect area 34. In addition, this main jet proper, or the so-called carrier jet 31, has been arranged to form turbulent areas 32. As is observed in FIG. 5, the turbulent areas 32 of the main jet 31 create merely a slight vacuum in the area 33. Such a vacuum induces no harmful effect.

The inner surface **18*a* of the blow chamber 18 is advantageously an uninsulated surface, acting as a heat transfer surface for recovering the heat contained in the air to be purified and the heat radiated by any other heat sources, and for transferring the recovered heat to the incoming, or blow air flowing in the blow chamber 18**.

The nozzles 20 of the invention have been so dimensioned that the spacing of the nozzles is advantageously at least approximately three times the diameter of the nozzles. Hereby, in the air exhausting means of the invention the desired effect as in FIG. 6 is achieved, the nozzles 20 having been arranged to blow air so that the detrimental kitchen air containing impurities is drawn to the vicinity of the nozzles in the manner shown in FIG. 6.

Figure 8:
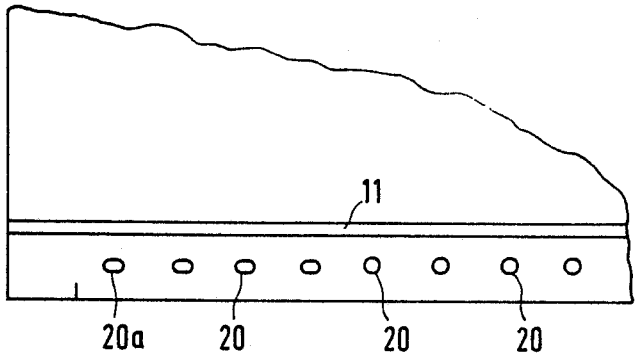
FIG. 8 presents the blow aperture depicted in FIG. 4 more in detail.
Figure 9:
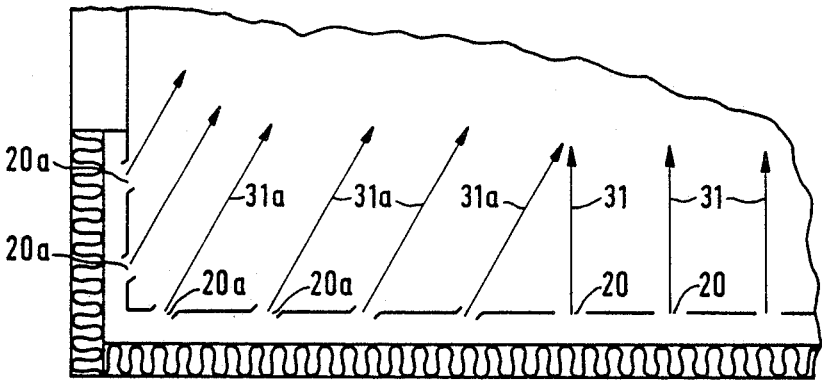
FIG. 9 presents in the top view the blow jets directed by the blow apertures of FIG. 8.
Figure 10:
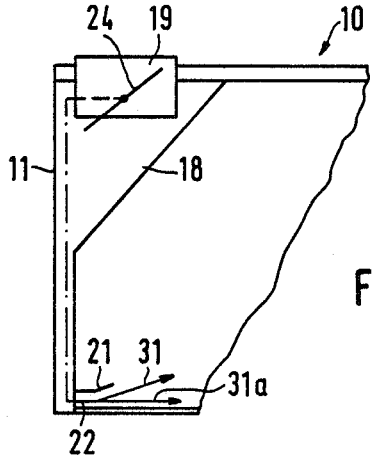
FIG. 10 presents, in elevational view, the blow jets of FIG. 9.

In accordance with an advantageous embodiment of the invention, as depicted in FIGS. 8–10, the nozzles **20*a* of the marginal areas of the air exhausting means 10 have been fitted to direct the blow jets 31*a* towards the central area of the air exhausting means 10, while nozzles 20 of the central area direct the blow jets 31 substantially directly forwardly. Thus, the blow jets 31 constitute the actual carrier jet 31. The blow jet 31a and the actual carrier jet 31 are in different planes, as is best seen in FIG. 10. The blow jets 31*a* are preferably directed under the carrier jet proper 31**.

The nozzles **20*a* have, as shown in FIG. 9, bevelled surfaces and they are moreover advantageously elliptical in shape, as is depicted in FIG. 8**.

The blow jets **31*a* exert an effect in both marginal areas of the air exhausting means 10 at a distance of 50 cm from the margins of the air exhausting means 10** towards the centre.

In the foregoing, only some advantageous embodiments of the invention have been presented, and it is clear to a person skilled in the art that numerous modifications thereof are feasible within the scope of the inventive idea presented above.

We claim:

1. Air exhausting device, intended e.g., for catering industry kitchens or equivalent, said air exhausting device comprising an outer housing, an exhaust chamber with at least one filtering unit within said outer housing, a collecting chamber for gaseous impurities within said outer housing, a blow chamber within said outer housing separate blow apertures of said blow chamber of the air exhausting device disposed to deliver a blow jet which induces a secondary air jet, said secondary air jet arranged on all sides of said blow apertures to exert an effect in its entirety in a proximity effect area, and a control baffle disposed above and in the vicinity of said blow apertures of said blow chamber, said control baffle arranged to direct said blow jet towards said filtering unit so that a maximally efficient ejection effect of said blow jet in the proximity effect area and maximal starting impulse are achieved, said impulse being arranged to die out substantially before arriving at said filtering unit.

2. Air exhausting device, intended in particular for catering industry kitchens or equivalent, said air exhausting device comprising an outer housing, an exhaust chamber with at least one filter unit within said outer housing, a collecting chamber for impurities within said outer housing, a blow chamber within said outer housing, and separate blow apertures of said blow chamber of the air exhausting device disposed to deliver a blow jet towards said exhaust chamber and inducing a secondary air jet, said blow apertures in end zones of the exhaust air device being fitted to direct the blow jets towards a central area of the air exhausting device.

3. The combination according to claim 2, wherein said blow apertures in the central area of the air exhausting device have been fitted to direct the blow jets substantially directly forwardly for forming a carrier jet proper.

4. The combination according to claim 2, wherein the blow jets produced by said blow apertures in the marginal areas of the air exhausting device and a main carrier jet are in different planes.

5. The combination according to claim 2, wherein the blow jets produced by said blow apertures in the marginal areas are directed under a carrier jet proper.

6. The combination according to claim 2, wherein said blow apertures in the marginal areas have bevelled surfaces.

7. The combination according to claim 2, wherein said blow apertures in the marginal areas are substantially elliptical in shape.

8. The combination according to claim 2, wherein the blow jets produced by said blow apertures in the marginal areas have been fitted to exert an effect in both marginal areas of the air exhausting device at about 0.5 m distance from the margins of the air exhausting device towards the centre.

9. The combination of claim 1, wherein said filtering unit comprises at least one suction aperture.

10. The combination of claim 1, wherein said filtering unit comprises at least one grease filter.

11. The combination of claim 2, wherein said filtering unit comprises at least one suction aperture.

12. The combination of claim 2, wherein said filtering unit comprises at least one grease filter.

13. The combination of claim 1, wherein spacing between adjacent blow apertures is greater than individual diameters of said blow apertures.

14. The combination of claim 13, wherein said spacing is about three times the individual diameters.

15. The combination of claim 10, wherein said filtering unit comprises a control damper for regulating air flow passing through the the grease filter.

16. The combination of claim 1, wherein said blow jet is directed substantially upwardly.

17. The combination of claim 2, wherein said blow jet is directed substantially upwardly.

18. The combination of claim 1, wherein said blow apertures are arranged in a lower part of said collecting chamber and across from and lower than said filtering unit.

19. The combination of claim 2, wherein said blow apertures are arranged in a lower part of said collecting chamber and across from and lower than said filtering unit.

20. The combination of claim 1, additionally comprising a grease channel formed on a side of said baffle adjacent said blow chamber.

21. The combination of claim 1, wherein said baffle and apertures are positioned to generate turbulent areas above and below a main jet stream issuing from said apertures in the direction of said filtering unit in said collecting chamber.

22. The combination of claim 2, wherein said apertures are positioned to generate turbulent areas above and below a main jet stream issuing from said apertures in the direction of said filtering unit in said collecting chamber.

23. The combination of claim 21, wherein said position of said baffle and said apertures additionally creates a slight vacuum in an area of said collecting chamber adjacent said blow chamber.

24. The combination of claim 22, wherein said position of said apertures additionally creates a slight vacuum in an area of said collecting chamber adjacent said blow chamber.

25. The combination of claim 2, wherein spacing between adjacent blow apertures is greater than individual diameters of said blow apertures.

26. The combination of claim 25, wherein said spacing is about three times the individual diameters.

27. The combination of claim 12, wherein said filtering unit comprises a control damper for regulating air flow passing through the grease filter.

28. The combination of claim 27, wherein said control damper is disposed next to the grease filter to be slidable, in relation to the filter, on the side of incoming air.

29. The combination of claim 1, wherein said baffle is upwardly inclined at an angle in a direction away from said apertures.

30. The combination according to claim 15, wherein said control damper is disposed next to the grease filter to be slidable, in relation to the filter, on the side of incoming air.

* * * * *